US006783410B2

(12) United States Patent
Florander et al.

(10) Patent No.: US 6,783,410 B2
(45) Date of Patent: Aug. 31, 2004

(54) DRIVE MEANS IN A BOAT

(75) Inventors: Nils-Ake Florander, Hisings Backa (SE); Oddbjorn Hallenstvedt, Valskog (SE); Kare Jonsson, Trollhattan (SE)

(73) Assignee: Volvo Penta AB, Gothenburg (SE)

( * ) Notice: Subject to any disclaimer, the term of this patent is extended or adjusted under 35 U.S.C. 154(b) by 0 days.

(21) Appl. No.: 10/182,667

(22) PCT Filed: Feb. 1, 2001

(86) PCT No.: PCT/SE01/00193

§ 371 (c)(1),
(2), (4) Date: Nov. 8, 2002

(87) PCT Pub. No.: WO01/56876

PCT Pub. Date: Aug. 9, 2001

(65) Prior Publication Data

US 2003/0139102 A1 Jul. 24, 2003

(30) Foreign Application Priority Data

Feb. 2, 2000 (SE) ..... 0000333

(51) Int. Cl.[7] ..... B63H 25/42
(52) U.S. Cl. ..... 440/51
(58) Field of Search ..... 440/51, 80, 81, 440/83; 114/162, 163, 167, 144 B

(56) References Cited

U.S. PATENT DOCUMENTS

| | | | | | |
|---|---|---|---|---|---|
| 1,932,523 | A | * | 10/1933 | Irgens | 416/93 R |
| 1,990,387 | A | * | 2/1935 | Linthwaite | 440/56 |
| 3,150,631 | A | * | 9/1964 | Tillman | 440/56 |
| 4,073,258 | A | * | 2/1978 | Logan | 440/41 |
| RE34,011 | E | * | 7/1992 | Brandt | 114/144 R |
| 5,439,403 | A | * | 8/1995 | Rolla | 440/51 |
| 5,632,658 | A | * | 5/1997 | Chen et al. | 440/49 |
| 6,165,031 | A | * | 12/2000 | Lonngren et al. | 440/51 |

FOREIGN PATENT DOCUMENTS

| | | | |
|---|---|---|---|
| DE | 35 19 599 | | 1/1986 |
| DE | 196 40 481 | | 5/1998 |
| EP | 0 215 758 | | 3/1987 |
| EP | 0 269 272 | | 6/1988 |
| FR | 2 771 372 | | 5/1999 |
| JP | 60-113799 | * | 6/1986 |

* cited by examiner

*Primary Examiner*—Ed Swinehart
(74) *Attorney, Agent, or Firm*—Young & Thompson

(57) ABSTRACT

Boat propeller drive unit with an underwater housing (5), which is solidly joined to a boat hull and has pulling propellers (15, 16) on the forward facing side of the housing. At the aft edge of the underwater housing, a rudder is mounted, comprising a first rudder blade (22*a*) mounted in the underwater housing and a second rudder blade (22*c*) mounted on the aft edge of the first rudder blade.

21 Claims, 4 Drawing Sheets

DRIVE MEANS IN A BOAT

BACKGROUND OF THE INVENTION

The present invention relates to a boat drive unit, comprising a propeller drive unit fixedly arranged to the outside of a boat hull, having an at least essentially vertical drive shaft, which, via an angle gearing enclosed in an underwater housing, drives at least an essentially horizontal propeller shaft with a tractive propeller arranged on the forward facing side of the underwater housing, a rudder mounted in a wing-profile-like portion of the underwater housing for pivoting about a vertical axis aft of the propeller and a drive unit arranged inside the hull, with which the vertical drive shaft is drivably connected.

A drive unit of this type is shown and described in e.g. EP 0 269 272. The advantage of arranging the propeller to be tractive, i.e. pulling, instead of pushing is that it will then work in undisturbed water, since the underwater housing of the drive unit will lie behind the propeller. This makes it also possible to make the rudder as a wing flap-like extension of an underwater housing with a wing profile. The result will be a propeller drive with high propeller efficiency. The installation will be simplified and the installation weight will be lower than that of a steerable drive unit with a pushing propeller.

The steering capability will be good at most speeds, even with a rudder blade, the area of which is less than half of the wing profile of the underwater housing. What one might suspect is that the steering capability would be somewhat poorer than that of a steerable drive at lower speeds but comparable at higher speeds. The result in practice, however, can be just the opposite. At speeds of circa 30 knots and upwards, at rudder angles greater than a certain angle, cavitation can occur, leading in the worst case to the rudder completely losing its grip and thus the loss of steering capability.

SUMMARY OF THE INVENTION

The purpose of the present invention is in general to achieve a drive unit of the type described by way of introduction with a small rudder which provides high steering forces at all speeds and, above all, eliminates the risk of the rudder losing its grip due to cavitation at high speeds.

This is achieved according to the invention by virtue of the fact that the rudder comprises a first rudder blade, which is mounted in the underwater housing for pivoting about a first vertical pivot axes, and a second rudder blade, which is mounted in an aft-facing edge of the first rudder blade for pivoting relative to the first rudder blade about a second vertical pivot axis.

By arranging the first rudder blade as a main rudder and the second rudder blade as a wing flap on the main rudder, the centre of pressure of the underwater housing and the lateral plane formed by the first and second rudder blades will be moved aft, which creates a larger steering force than if the two rudder blades were to be replaced by a single rudder blade having the same surface area. It has been shown that if the second rudder blade has a surface which is not greater than circa 30–40% of the surface of the first rudder blade, and the steering angle of the second rudder blade relative to the first rudder blade is equal to the steering angle of the first rudder blade relative to the underwater housing, a steering angle of circa 10° for each rudder blade is sufficient to achieve the same steering force as a 20° steering angle of a drive unit with a single rudder blade. The smaller the steering angle is, the less will be the risk of cavitation when turning at high speeds, in order to achieve a pressure differential which is as great as possible between the two sides of the lateral plane when turning, the gap between the underwater body of the drive unit and the pivotable rudder must be as small as possible. The smaller the required maximum rudder steering angle, the simpler it will be to achieve a smooth and gapless transition between the aft-edge of the wing-profile underwater body and the forward edge of the rudder. There should preferably be no gap at all between the underwater housing and the first rudder blade and between the first and second rudder blades. In a preferred embodiment, sealing strips are used to completely seal the gaps.

In order to gain additional advantage from the fact that a tractive propeller on a propeller drive unit works in undisturbed water in front of the underwater body of the drive unit and thus has higher propeller efficiency than a pushing propeller, in a preferred embodiment of the drive unit according to the invention, the angle gear unit is arranged to counter-rotationally drive two concentric, essentially horizontal propeller shafts each having an individual propeller. In this manner the total efficiency of the drive unit can be further increased. Drive units of this type are particularly suited to fast boats of a size exceeding 40 feet, where double propeller arrangements provide high performance at the same time as the rudder arrangement with a main rudder and a rudder similar to a wing flap assures good maneuverability at all speeds.

Another possibility, provided by a drive unit with a tractive propeller, is placement of the exhaust port in the aft-edge of the underwater housing, to utilize the ejector effect which the water flowing by exerts on the exiting exhaust, in the same manner as when the exhaust exits through the propeller hub. When the exhaust exits through the aft-edge of the underwater housing instead of through the hub, the hub diameter can be reduced, which is to advantage in several respects. On the one hand, the mass and the mass forces are reduced, and on the other hand, the space required under the hull bottom is reduced, which means that the drive unit leg can be made shorter and thus lighter than for propellers with exhaust exit in the hub.

It has proved to be hydrodynamically advantageous, even with a drive unit with the above described combination of a main rudder and a rudder resembling a wing flap, to arrange a double propeller combination, known per se, with an aft-propeller, which, at least at higher speeds, cavitates when the forward propeller does not cavitate.

BRIEF DESCRIPTION OF THE DRAWINGS

The invention will be described in more detail below with reference to examples shown in the accompanying drawings, where.

DETAILDED DESCRIPTION OF THE PREFERED EMBODIMENTS

Figure 1:
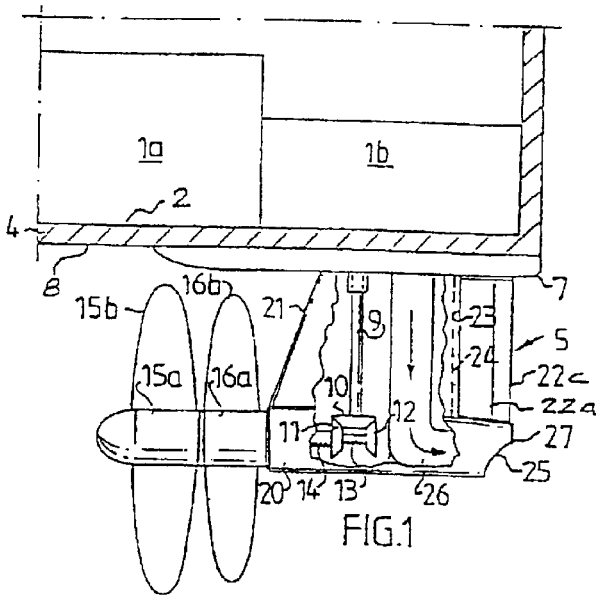
FIG. 1 shows schematically a partially cut-away side view of one embodiment of a drive unit according to the invention.

In FIG. 1, 1 generally designates a drive unit consisting of an engine 1*a* and a reversing mechanism 1*b*, which are fixed to an inner surface 2 in the bottom 4 of a boat hull. An underwater housing 5 has a mounting plate 7, which is fixed to an outer surface 8 on the bottom 4. The engine 1*a* drives, via an angle gear unit in the reversing gear 1*b*, an output shaft 9, which in turn, via an angle gear unit with bevel gears 10, 11 and 12, drives a pair of propeller shafts 13 and 14, of which the shaft 14 is a hollow shaft, through which the shaft 13 extends. The shaft 13 carries a propeller 15 with a hub 15*a* and a blade 15*b*, and the shaft 14 carries a propeller 16 with a hub 16*a* and a blade 16*b*.

Figure 3:
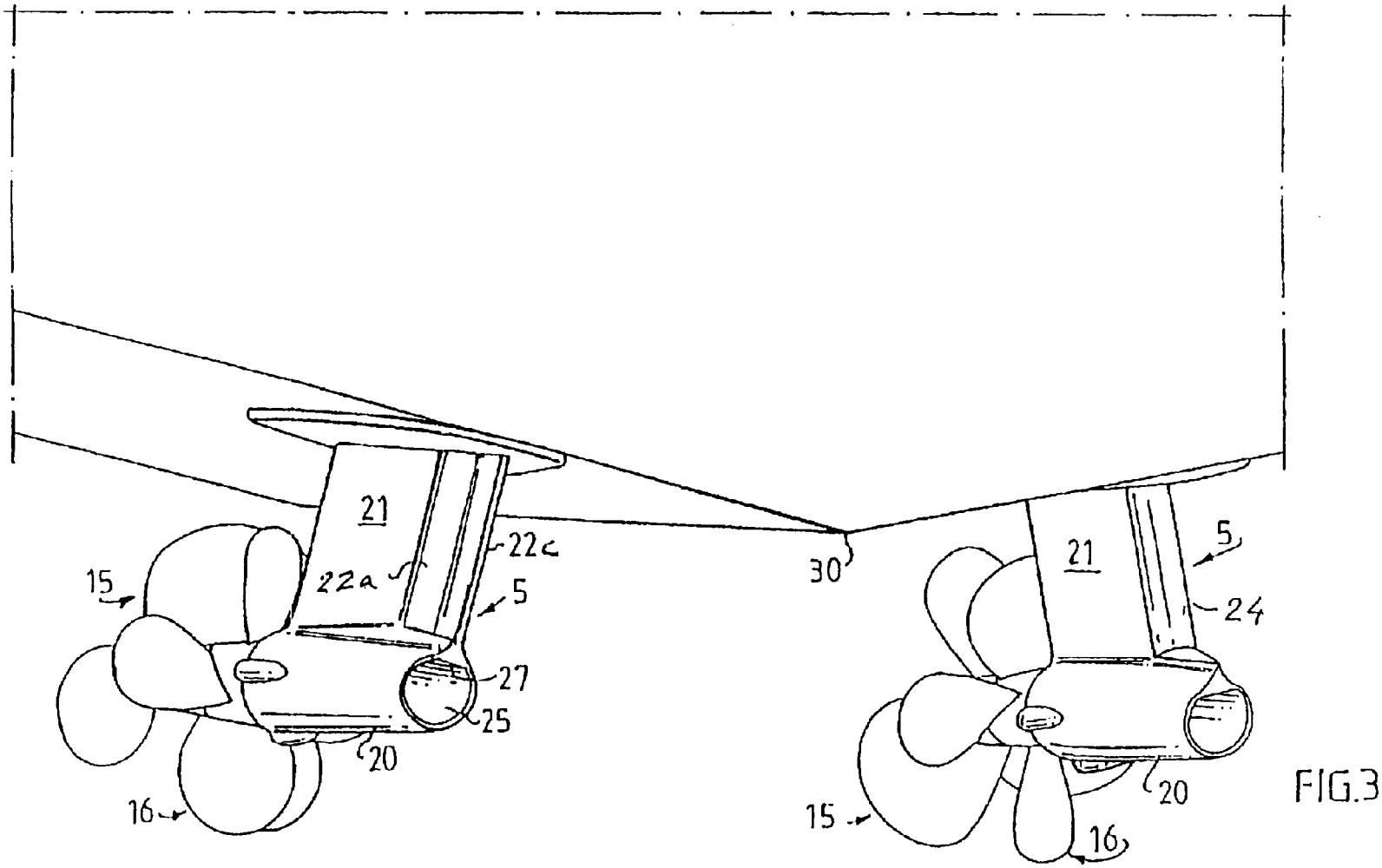
FIG. 3 shows a perspective view of a drive installation comprising two drive units shown in FIGS. 1 and 2.
Figure 6:
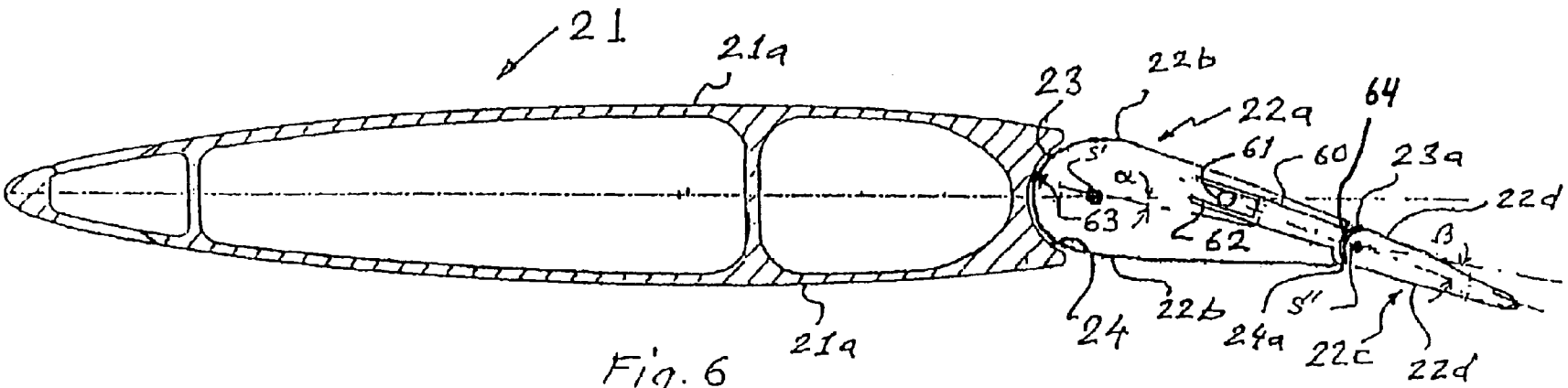
FIG. 6 shows a section along the line II—II in FIG. 2.

The propeller shafts 13 and 14 are mounted in a torpedo-like portion 20 of the underwater housing 5. The housing portion 21 between the torpedo and the mounting plate 7 has, as is shown most clearly in FIG. 6, a wing like profile with gently curved side surfaces 21*a* on either side of a vertical plane of symmetry. At the aft-edge of the housing portion 21, a first rudder blade 22*a* is mounted for pivoting about a vertical steering axis s'. The forward end portion 23 of the rudder blade 22*a* has a semicircular cross section and extends into a semicircular gutter 24 in the housing portion 21, as can also be seen in FIG. 3, where the starboard drive unit is shown with the rudder blade removed. The lateral side surfaces 22*b* of the rudder blade 22*a* at their forward edges are coplanar with the aft-edge of the lateral surfaces 21*a* of the housing portion 21, so that there is a smooth transition between the housing portion 21 and the rudder blade 22*a*. As can be seen in FIG. 6, a sealing strip 63, e.g. of rubber, is laid in a vertical groove in the rudder blade 22*a* to seal the gap between the components 23 and 24.

According to the invention, a second rudder blade 22*c* is mounted to the aft-edge of the first rudder blade 22*a* for pivoting about a second vertical steering axis s". The second rudder blade 22*c* has forward end portion 23*a* with a semicircular cross section, which extends into a semicircular gutter 24*a* in the aft-edge of the first rudder blade 22*a*. The second rudder blade 22*c* has lateral surfaces 22*d*, which at their forward edges lie coplanar with the lateral surfaces 22*b* of the first rudder blade, so as to provide an even transition between the two rudder blades 22*a* and 22*c*. A sealing strip 64 corresponding to the strip 63 is laid in a vertical groove in the rudder blade 22*c* to seal the gap between the components 23*a* and 24*a*.

The first rudder blade 22*a* is pivotable about the steering axis s' by means of a steering mechanism, which is known per se and is not shown in more detail here, for example a steering arm joined to the rudder blade and a hydraulic piston cylinder arrangement acting between the steering arm and a stationary element. The two rudder blades are coupled together by means of a transmission arrangement, which transmits a pivot movement of the first rudder blade 22*a* relative to the housing 21 to generate a pivot movement of the second rudder blade 22*c* relative to the first rudder blade 22*a* about the steering axis s". FIG. 6 shows schematically such a transmission arrangement consisting of a steering arm 60, solidly joined to the second rudder blade 22*c*, and a vertical steering pin 61 which is joined to the plate 7. The steering pin extends into a fork-like end 62 of the steering arm 60. The steering pin 61 can be solidly joined to the plate 7, so that a certain steering angle of the first rudder blade 22*a* creates a certain steering angle, depending on the length of the steering arm, for the second rudder blade 22*c*. For example, a certain steering angle of the first rudder blade, i.e. an angle $\alpha$ relative to the housing portion 21, creates a pivot angle $\beta$ of equal dimension in the second rudder blade 22*c* relative to the first rudder blade 22*a*. In an alternative embodiment (not shown), the steering pin 61 can be arranged to be displaceable athwartships, to make it possible to pivot the second rudder blade 22*c* without pivoting the first rudder blade 22*a*, for example for trimming when moving through waves coming from the side. The pin 61 can, for example, be mounted on a rotatable excentric plate, the turning of which causes a lateral displacement of the pin 61.

As can be seen in the figures, the aft-edge of the second rudder blade 22*c* is at the same height as the aft-end of the torpedo 20. The torpedo is provided with a blow-out opening 25 for the mouth of an exhaust pipe 26. As can also be seen in the figures, the aft-edge of the torpedo is provided with a shield 27 towards the aft-rudder blade 22*c* to screen the rudder blade from the exhaust flow. By virtue of the fact that the exhaust is directed out through the underwater housing and not through the propellers hubs 15*a* and 16*a*, the hub diameters and thus the diameter of the entire propeller can be reduced. In steerable drive units with pushing propellers, the largest diameter of the hubs is normally equal to the largest diameter of the adjoining portion of the underwater housing, while the largest hub diameter of the propellers 15 and 16 shown in FIGS. 2–5 is approximately 60–65% of the largest diameter of the torpedo where they join the propellers. Since the propellers require a certain minimum spacing to the hull bottom line above them, the vertical length of the underwater housing is also affected by the propeller diameter, which means that the smaller the diameter of the propeller, the shorter will be the required vertical dimension of the underwater housing. This also means that the vertical dimension of the rudder blades 22*a* and 22*c* will be relatively limited. It has, however, been demonstrated that with the rudder blade combination, shown and described, in a fast motorboat with a size of about 40 feet, a combined rudder blade surface of circa 200×200 mm will provide sufficient steering force. The surface of the aft rudder blade 22*c* is then chosen to be circa 30–40% of the surface of the forward rudder blade 22*a*.

Figure 2:
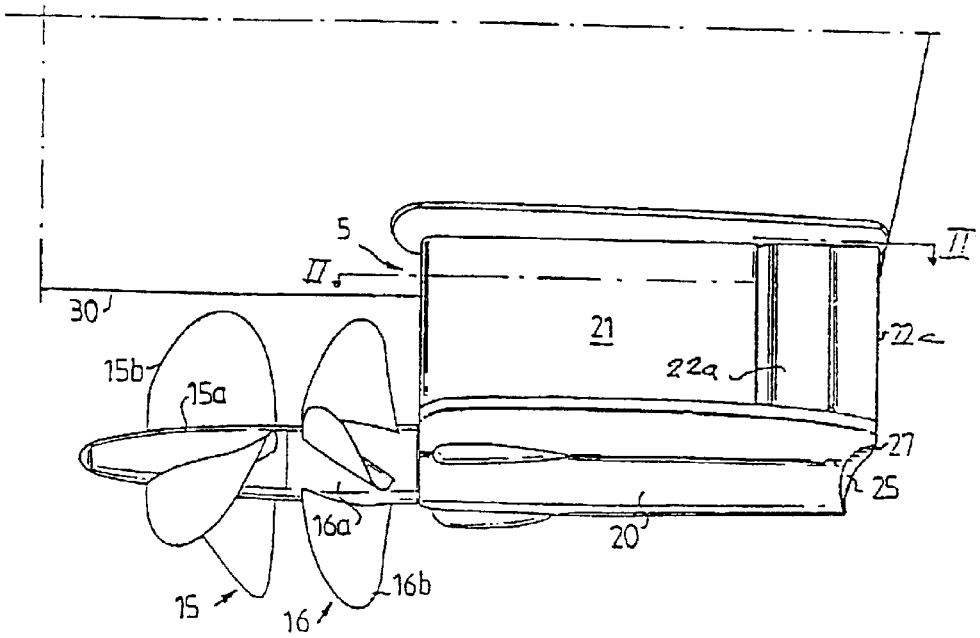
FIG. 2 shows a pure side view of the drive unit in FIG. 1.

FIG. 2 shows a propeller drive unit of the type described in connection with FIG. 1, i.e. a drive unit with an underwater housing 5, which is fixed directly to the bottom surface of the boat hull by means of its mounting plate 7. The drive unit has two propellers 15 and 16, of which the forward propeller has three blades and the aft-propeller has four blades. In a preferred embodiment, the blade areas of the propellers are also adapted to each other in such a way that, within a predetermined upper rpm range, the aft-propeller cavitates while the forward propeller does not cavitate.

The propeller drive unit shown in FIG. 2 is mounted to one side and spaced from the centerline 30 of the hull. A corresponding propeller drive unit is mounted on the other side of the centerline 30, as is shown in more detail in FIG. 3. As was mentioned above, the rudder blades of the right-hand drive unit have been removed to show more clearly the shape of the wing-like part 21 of the underwater housing 5. When double-mounted, it can be advantageous to arrange means (not shown) which make it possible to disconnect the normal synchronous maneuvering of the rudder blades and instead steer the rudder blades as mirror images, i.e. so that a certain rudder angle in one drive unit to port, for example, leads to a corresponding rudder angle to starboard in the other drive unit. Thus, the steering angles cancel each other and the rudders function instead as brake flaps without steering effect.

Figure 4:
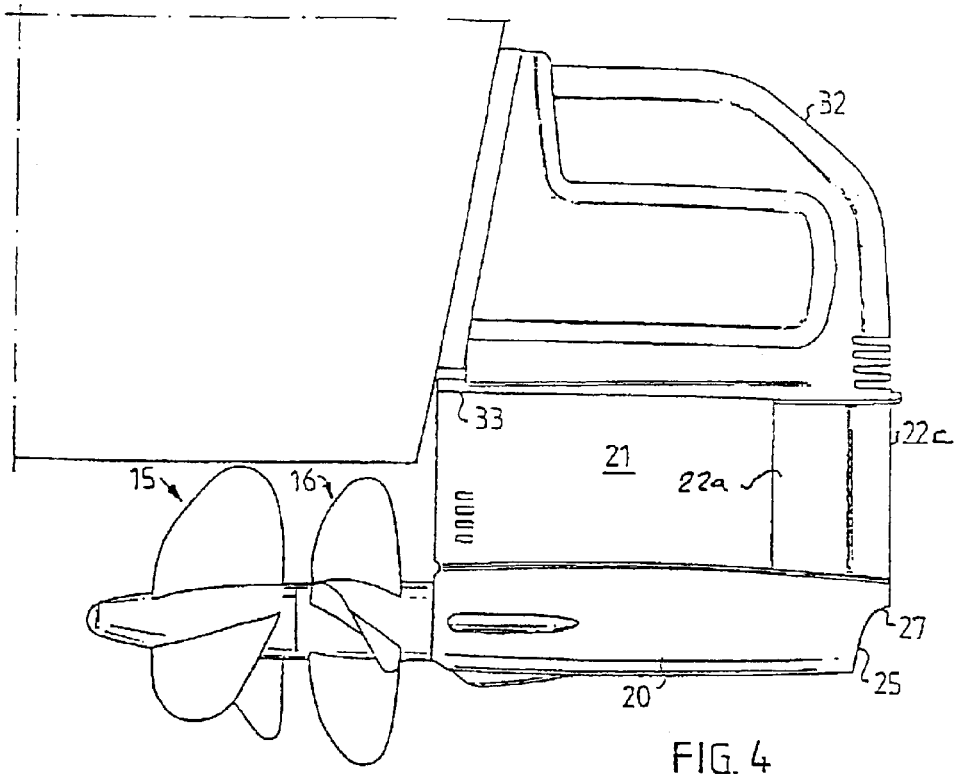
FIG. 4 is a side view of another embodiment of a drive unit according to the invention.
Figure 5:
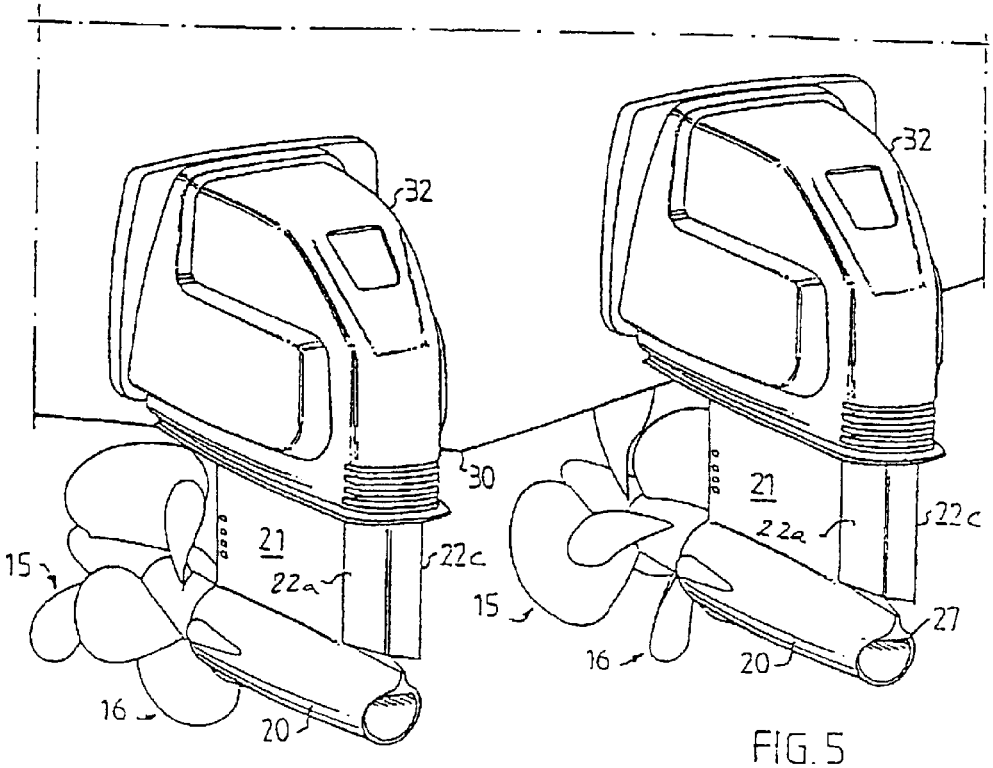
FIG. 5 shows a perspective view of a drive installation comprising two drive units of the type shown in FIG. 4.

FIG. 4 shows an embodiment of a propeller drive unit according to the invention, which differs from that described above only in that the underwater housing 21 is joined to a housing 32 mounted against the transom 31 of the hull. The housing 32 contains an angle gearing and a reversing mechanism with an output shaft which is connected to the shaft 9 (FIG. 1). In the transition between the housing 32 and the underwater housing 21, there is a cavitation plate, to which there is fixed a steering pin (not shown) corresponding to the steering pin 61. FIG. 5 shows a boat hull with two drive units of the type shown in FIG. 4, which are mounted on a transom equidistant from the centerline 30.

If required, a transmission corresponding to the steering arm 60 and the steering pin 61 can also be arranged between the underside of the rudder blades and the torpedo 20. Other transmission means are of course also conceivable between the first and second rudder blades 22*a* and 29*b*, respectively, to transmit the pivot movement of the first rudder blade to the second rudder blade.

What is claimed is:

1. Drive arrangement in a boat, comprising a propeller drive unit fixedly arranged to the outside of a boat hull, having an at least essentially vertical drive shaft, which, via an angle gearing enclosed in an underwater housing, drives at least an essentially horizontal propeller shaft with a tractive propeller arranged on the forward facing side of the underwater housing, a rudder mounted in a wing-profile-like portion of the underwater housing for pivoting about a vertical axis aft of the propeller and a drive unit arranged inside the hull, with which the vertical drive shaft is drivably connected, characterized in that the rudder comprises a first rudder blade (22*a*), which is mounted in the underwater housing (5) for pivoting about a first vertical pivot axis (s'), and a second rudder blade (22*c*), which is mounted in an aft-facing edge of the first rudder blade for pivoting relative to the first rudder blade about a second vertical pivot axis (s").

2. Drive arrangement according to claim 1, characterized in that control means (60, 61) are arranged which, upon pivoting of the first rudder blade (22*a*) relative to the underwater housing (5), pivot the second-rudder blade (22*c*) relative to the first rudder blade.

3. Drive arrangement according to claim 2, characterized in that the control means (60, 61) are arranged to pivot the second rudder blade an angle (13) which is dependent on the pivot angle ($\alpha$) of the first rudder blade.

4. Drive arrangement according to claim 3, characterized in that the control means (60, 61) are arranged to pivot the second rudder blade (22*c*) an angle (13) relative to the first rudder blade (22*a*), which is essentially equal to the pivot angle ($\alpha$) of the first rudder blade relative to the underwater housing (5).

5. Drive arrangement according to claim 3, characterized in that the control means comprise transmission means (60, 61) arranged between the second rudder blade (22*c*) and an element (7) separate from the first rudder blade.

6. Drive arrangement according to claim 5, characterized in that said transmission means comprise at least one steering arm (60) joined to the second rudder blade (22*c*), said steering arm engaging and being pivotable and longitudinally displaceable relative to a guide (61) separate from the first rudder blade.

7. Drive arrangement according to claim 1, characterized in that second rudder blade (22*c*) has a cross-sectionally convex forward edge (23*a*), which is lodged in a concave gutter (24*a*) in the aft-edge of the first rudder blade (22*a*).

8. Drive arrangement according to claim 1, characterized in that the second rudder blade (22*c*) has a steering surface, which amounts to between 30% and 40% of the steering surface of the first rudder blade (22*a*).

9. Drive arrangement according to claim 1, characterized in that the angle gearing (10,11,12) drives counter-rotationally a pair of concentric, at least essentially horizontal, propeller shafts (13,14) for individual propellers (15, 16).

10. Drive arrangement according to claim 1, characterized in that the underwater housing (5) has a lower torpedo-like portion (20), which is joined to the lower edge of the wing-profile-like portion (21) and in which the propeller shaft(s) is(are) mounted.

11. Drive arrangement according to claim 10, characterized in that the length of the torpedo-like portion (20) is at least essentially equal to the sum of the lengths of the wing-profile-like portion (21) and the rudder blades (22*a*, 22*c*).

12. Drive arrangement according to claim 11, characterized in that the torpedo-like portion (20) has, in its aft-facing end portion, an exhaust port (25) from an internal combustion engine driving said vertical shaft.

13. Drive arrangement according to claim 12, characterized in that the aft-facing portion of the torpedo-like portion (20) is shaped so that a screen (27) is formed between the second rudder blade (22*c*) and an exhaust port (25).

14. Drive arrangement according to claim 1, characterized in that the propeller(s) (15,16) are made with a hub (15*a*, 16*a*), the largest diameter of which is less than the largest diameter of the torpedo-like portion (20).

15. Drive arrangement according to claim 14, characterized in that the largest propeller hub diameter is circa 20% of the propeller diameter.

16. Drive arrangement according to claim 1, characterized in that the wing-profile-like portion (21) of the underwater housing has means (7) for fixing the portion to the underside of the hull bottom.

17. Drive arrangement according to claim 1, characterized in that the underwater housing (5) is joined to a drive leg (32), which is fixable to a hull transom.

18. Drive arrangement according to claim 9 characterized in that the blade areas of the propellers are so adapted to each other that, at least under certain operating conditions, the aft-propeller (16) operates cavitatingly, while the forward propeller (15) operates non-cavitatingly.

19. Drive installation in a boat, comprising two laterally arranged drive arrangements according to claim 1, characterized in that the rudders are pivotable individually to provide rudder steering angles in opposite directions.

20. Drive arrangement in a boat, comprising a propeller drive unit fixedly arranged to the outside of a boat hull, having an at least essentially vertical drive shaft, which, via an angle gearing enclosed in an underwater housing, drives at least an essentially horizontal propeller shaft with a tractive propeller arranged on the forward facing side of the underwater housing, a rudder mounted in a wing-profile-like portion of the underwater housing for pivoting about a vertical axis aft of the propeller and a drive unit arranged inside the hull, with which the vertical drive shaft is drivably connected, wherein that the rudder comprises a first rudder blade, which is mounted in the underwater housing for pivoting about a first vertical pivot axis, and a second rudder blade, which is mounted in an aft-facing edge of the first rudder blade for pivoting relative to the first rudder blade about a second vertical pivot axis, wherein a sealing strip is arranged between the underwater housing and the first rudder blade and between the first rudder blade and the second rudder blade.

21. A drive arrangement in a boat, comprising:

a propeller drive unit having an essentially vertical drive shaft, which drives an essentially horizontal propeller shaft with a tractive propeller arranged on the forward facing side of a housing;

a rudder mounted in the housing for pivoting about a vertical axis aft of the propeller, said rudder comprising a first rudder blade that pivots about a first vertical pivot axis, and a second rudder blade, which is mounted in an aft-facing edge of the first rudder blade and pivots relative to the first rudder blade about a second vertical pivot axis; and a transmission arrangement which transmits a pivot movement of the first rudder blade relative to the housing to generate a pivot movement of the second rudder blade relative to the first rudder blade about the second pivot axis, said transmission arrangement comprising a steering arm having a forked end, said steering arm being connected to the second rudder blade at an end opposite said forked end, and a fixed vertical steering pin extending into said forked end, so that a certain steering angle of the first rudder blade creates a certain steering angle for the second rudder blade.

* * * * *